United States Patent [19]

Sakakura et al.

[11] Patent Number: 4,762,575

[45] Date of Patent: Aug. 9, 1988

[54] PROCESS FOR PRODUCING ELECTRICAL STEEL SHEET

[75] Inventors: Akira Sakakura, Chiba; Kazuo Hoshino, Yamaguchi; Yoshihiro Uematsu, Yamaguchi; Takashi Igawa, Yamaguchi; Hiroshi Fujimoto, Yamaguchi, all of Japan

[73] Assignee: Nisshin Steel Co., Ltd., Tokyo, Japan

[21] Appl. No.: 874,088

[22] Filed: Jun. 13, 1986

[30] Foreign Application Priority Data

Jun. 26, 1985 [JP] Japan ..... 60-138039

[51] Int. Cl.[4] ..... H01F 1/04

[52] U.S. Cl. ..... 148/111; 148/112; 148/120

[58] Field of Search ..... 148/111, 112, 120

[56] References Cited

U.S. PATENT DOCUMENTS 2,943,007 6/1960 Walker et al. ..... 148/120
3,058,857 10/1962 Pavlovic et al. ..... 148/120
3,090,711 5/1963 Kohler ..... 148/112
3,695,946 10/1972 Demeaux ..... 148/120

FOREIGN PATENT DOCUMENTS 940811 11/1963 United Kingdom ..... 148/112

*Primary Examiner*—John P. Sheehan
*Attorney, Agent, or Firm*—Wenderoth, Lind & Ponack

[57] ABSTRACT

A process for the production of an electrical steel sheet having the ideal (100) [001] cube texture of iron of iron alloy, comprising cold rolling a sheet of a single crystal or large grained crystals of iron or iron alloy, in which said single crystal is or a majority of said large grained crystals are oriented so that the pole of the {114} plane may form an angle not greater than 15° with the normal direction of the plane of the sheet, and the <401> direction may form an angle of not greater than 15° with a single direction in the plane of the sheet, in said single direction at a rolling reduction of at least 40%, and annealing the rolled sheet to form a primary recrystallization texture of fine grains of an average grain size of not larger than 5 mm under conditions preventing the occurrence of secondary recrystallization.

7 Claims, 9 Drawing Sheets

R.D. : ROLLING DIRECTION

R.D. : ROLLING DIRECTION

| CRYSTAL NO. | INITIAL ORIENTATION | SECONDARY RECRYSTALLIZATION ORIENTATION |
|---|---|---|
| 9 | • | ● |
| 10 | • | ○ |
| 32 | • | ◑ |
| C2 | • | △ |
| 124 | • | x |

PROCESS FOR PRODUCING ELECTRICAL STEEL SHEET

FIELD OF THE INVENTION

The present invention relates to a novel process for the production of an electrical steel sheet having the <100> axes of easy magnetization in a direction of rolling as well as in a direction perpendicular thereto.

PRIOR ART

It has heretofore been very difficult to commercially produce an electrical steel sheet of the ideal cube texture orientation having the <100> axes of easy magnetization in a direction of rolling as well as in a direction perpendicular thereto.

Electrical steel sheets of the cube texture, as soft magnetic materials, were extensively studied in the 1950s and 1960s, primarily for the purpose of using them as core materials for rotors and other electrical instruments. It was very difficult, however, to realize crystal grains of the ideal (100) [001] orientation with ferritic steels of the body-centered cubic lattice structure. We have found a new commercial process for the production of an electrical steel sheet of the ideal cube texture, which is the subject matter of the invention. Before describing the invention, the state of the typical prior art will be described in some detail for the purpose of clarifying differences between the prior art and the invention. Incidentally, various magnetic properties referred to herein are shown in the following units:

$H_c$, $H_{15}$ and the likes in Oersted;

$B_1$, $B_5$, $B_{10}$, $B_r$, $B_{max}$ and the likes in Gauss: and $W_{10/50}$, $W_{15/50}$ and the likes in W/kg.

(1) Multiple Stage Cold Rolling of an Oriented Ingot (General Electric Company)

JP, B1, No. 33-7952 (JP, B1 designates a Japanese Patent Publication for which the application was filed in 1975 or before) discloses and claims a method for producing polycrystalline sheet-like metal having the body-centered cubic crystal lattice form by rolling and heat treating in which a majority of the grains thereof have the cube texture preferred orientation with respect to the rolling direction and rolling plane of said sheet, comprising the steps of:

providing a polycrystalline sheet-like body of metal having the body-centered cubic crystal lattice form in which a majority of the grains comprising said body have been recrystallized by annealing the metal following previous working and which have their unit cube lattices so oriented that a first pair of opposite, parallel cube faces are substantially parallel to the plane of the sheet and another pair of opposite, parallel cube faces are substantially perpendicular to said first pair of unit cube faces and are substantially perpendicular to a single direction in the plane of the sheet, reducing the thickness of the sheet-like body by at least 40% by cold rolling during which the rolling direction is maintained substantially parallel to said single direction, and causing said cold worked material to recrystallize in the cube texture preferred orientation by annealing said body for an interval of time up to about 8 hours at a temperature of from about 800° C. to 1200° C.

The term "cube texture" is synonymous with double orientation appearing in a double oriented silicon steel sheet, and means a texture of (100) [001] type grain orientation. The principle underlying the method of JP, B1, No. 33-7952 is understood such that when cold rolled and annealed under controlled conditions, crystals having a cube texture recrystallize again to a cube texture. This is fully discussed in JP, B1, No. 33-7953, which is a related patent to the JP, B1, No. 33-7952 and also in Transactions of the Metallurgical Society of Aime, Vol. 212 (1958), p. 731, "Texture of Cold-Rolled and Recrystallized Crystals of Silicon-Iron" by J. L. Walter and W. R. Hibbard, Jr. There are many patents relating to processes based on the above-mentioned principle. Those Japanese patents include, for example, JP, B1, Nos. 33-7952, 33-7953, 33-7509, 37-17453, 34-9110, 34-9572 and 36-20557, all assigned to General Electric Company.

Magnetic properties of a typical product of General Electric Company are shown in the following table.

TABLE 1

Magnetic Properties of Product of General Electric Company (Thickness of 0.3 mm; from JP, B1, 33-7509)

| | $H_c$ | $B_r$ | $B_z$ | $\mu_{max}$ |
|---|---|---|---|---|
| Rolling Direction | | | | |
| Cube Texture | 0.1 | 13100 | 15300 | 90600 |
| Goss Texture | 0.1 | 14100 | 15750 | 70500 |
| 90° Direction | | | | |
| Cube Texture | 0.135 | 11650 | 13300 | 58700 |
| Goss Texture | 0.30 | 4000 | 13100 | 7000 |

90° Direction: Transverse Direction (2) Utilization of Surface Energy (Vacuumschmelze AG)

JP, B1, No. 36-8554 discloses and claims a process for treating silicon iron alloy to form the cube texture in an silicon iron alloy containing from 2 to 5% of silicon in which a body of the silicon iron alloy is hot worked, thereafter cold worked one or more times, and then subjected to final annealing, characterized in that said final annealing is carried out at a temperature of at least 950° C., preferably at a temperature of from 1100° to 1350° C., for a period of from about 10 minutes to about 20 hours, during which the partial pressure of the annealing atmosphere is maintained sufficiently low on surfaces of the body to be annealed so that the annealing atmosphere on the surfaces of the body to be annealed at the annealing temperature may not allow any silicon oxide to be formed, rather it may cause any silicon oxide existing there to disappear; and that the annealing temperature, time and atmosphere are mutally adjusted, in particular, with a high annealing temperature a short annealing time is selected, in the case of a low annealing temperature a long annealing time is selected, and when the oxygen pressure is at the upper limit a very high annealing temperature is selected together with the correspondingly short annealing time, so that secondary recrystallization may proceed to form a substantially complete cube texture.

The principle underlying the process of JP, B1, No. 36-8554 is understood such that when the purity of the annealing atmosphere represented by the $O_2$ partial pressure is above a certain high level, the surface energy of the gas-metal interface is lower for crystal grains having the (100) crystal lattice plane in the plane of the sheet than for crystal grains having other planes in the plane of the sheet, and therefore secondary recrystallization proceeds in which the surface energy differential acts as the driving force. Technologies of this process have been extensibely investigated in universities and enterprises of several countries, including Germany, Japan and the USA. While some commercial products have been marketed, they are not widely used because of the expensive manufacturing cost.

We can mention many patents relating to processes based on the above-mentioned principle, including for example, DE, B1, No. 1,029,845 corresponding to the JP, B1, No. 36-8554 (DE, B1 designates a German Patent Auslegeschrift having no corresponding Offenlegungsschrift); DE, B1, No. 1,049,409; JP, B1, No. 35-15668; JP, B1, No. 39-313; JP, B1, No. 36-20588; JP, B1, No. 43-1963; JP, B1, No. 39-9671; FR, A, No. 1,168,022 (FR, A designates a French Brevet d'Inventiono published before 1969); DE, B1, No. 1,250,850; JP, B1, No. 36-20556; JP, B1, No. 38-14008; DE, B1, No. 1,149,374; JP, B1, No. 38-14007; U.S., A, No. 3,078,198 (U.S., A designates a U.S. Patent Specification); JP, B1, No. 37-18608; U.S., A, No. 3,240,638; JP, B1, No. 39-12240; JP, B1, No. 39-12241; GB, A, No. 932,923 (GB, A designates a United Kingdom Patent Specification of a number less than 1,605,255); JP, B1, No. 45-9656; JP, B1, No. 38-26256; JP, B1, No. 38-22705; JP, B1, No. 38-21858; JP, B1, No. 38-21857; U.S., A, No. 3,130,093; JP, B1, No. 42-5081; JP, B1, No. 40-29446; U.S., A, No. 3,152,930; FR, A, 1,372,238; U.S., A, 3,271,203; JP, B1, No. 40-11286; JP, B1, No. 41-7929; U.S., A, No. 3,413,165; FR, A, 1,450,626; U.S., A, No. 3,278,348; JP, B1, No. 44-28781; JP, B1, No. 44-32340; JP, B1, No. 46-8095; U.S., A, No. 3,640,780; JP, B1, No. 48-17565; JP, B1, No. 48-19767 and FR, A, No. 1,550,182.

Magnetic properties of some typical products obtained by the processes of this type are shown in the following tables.

TABLE 2

Magnetic Properties of Product of Vacuumschmelze AG (from JP, B1, 36-8554)

| | 14 KG (Oe) | 16 KG (Oe) | 18 KG (Oe) |
|---|---|---|---|
| Rolling Direction | | | |
| Cube Texture | 0.5 | 0.8 | 5.0 |
| Goss Texture | 0.5 | 1.0 | 10.0 |
| Rolling Direction | | | |
| Cube Texture | 0.6 | 2.0 | 12.0 |
| Goss Texture | 10.0 | 50.0 | 200.0 |

TABLE 3

Magnetic Properties of Product of JP, B1, 35-15668 (Rolling Direction; Thickness of 0.1 mm)

| | $B_1$ | $B_{10}$ | $H_c$ | $\mu_m$ |
|---|---|---|---|---|
| Cube Texture | 12700 | 16500 | 0.180 | 24500 |
| Goss Texture | 13000 | 16500 | 0.290 | 29500 |

TABLE 4

Magnetic Properties of Product of JP, B1, 39-12240 (Thickness of 0.3 mm)

| | $H_c$ | $B_r$ | $B_{0.5}$ | $B_1$ | $B_2$ | B/H |
|---|---|---|---|---|---|---|
| Cube Texture | 0.032 | 10500 | 1500 | 16125 | 17200 | 216000 |
| Goss Texture | 0.030 | 10875 | 1404 | 15850 | 16750 | 132000 |

TABLE 5

Magnetic Properties of Product of JP, B1, 44-28781 (Thickness of 0.3 mm)

| | $H_c$ | $B_{10}$ | $\mu_m$ |
|---|---|---|---|
| 3% Si—Fe | 0.072 | 16800 | 36500 |
| 4% Mo—Fe | 0.055 | 18600 | 55300 |

TABLE 6

Magnetic Properties of Products described in J. of Applied Physics; Vol. 29, No. 3 (1959), p. 363

| | Thickness | $H_c$ | $B_1$ | $B_5$ | $B_{10}$ | $\mu_m$ |
|---|---|---|---|---|---|---|
| a | 0.02 mm | 0.194 | 16000 | 17600 | 18000 | 37000 |
| a | 0.05 mm | 0.175 | 12900 | 16300 | 16800 | 27000 |
| b | 0.10 mm | 0.115 | 13300 | 16500 | 17000 | 42000 |
| b | 0.28 mm | 0.073 | 12700 | 15700 | 16600 | 37000 |

Note
a: Means of the values measured in the rolling and 90° directions.
b: Value measured in the rolling direction.

(3). Process Developed by Vereinigte Deutsche Metallwerke AG

U.S., A, No. 3,008,857 discloses and claims in a process for the production of pronounced (100) [100] texture in magnetizable sheets and strips of magnetizable iron alloys selected from the group consisting of magnetizable silicon iron alloys containing 0.5 to 3.5% of silcon, magnetizable aluminum iron alloys containing 0.5to 2.5% of aluminum and magnetizable silicon-aluminum iron alloys in which the content of silcon-+aluminum is from 0.5 to 3.5% in which hot rolled sheets and strips are cold rolled and then subjected to a final recrystallization anneal, in combination therewith, the steps which comprises subjecting the cold rolled stock to a predetermined aging for a predetermined period of time at a predetermined temperature between the cold rolling and the final recrystallization anneal, the temperature and duration of such predetermined aging being such as to cause an improvement in the quality of the (100) [001] grain orientation achieved upon the final recrystallization anneal and ranging from room temperature for a period of 2 to 10 days and to 100° C. for a period of about 1 to 10 hours.

Stages in which the cube texture is formed in the above-mentioned process is reported in detail in Archiv für das Eisenhüttenwessen, 29 Jahrsgang, Hefte 7, Jule 1956, s. 423, E. Moebius und F. Pawlek; Die Würfellage als Rekristallisations-textur bei Eisen-Silizium Regierungen. Patents relating to this process are DE, B1, No. 1,009,214; JP, B1, No. 36-7352; U.S., A, No. 3,008,857; and JP, B1, No. 44-23745.

Magnetic properties of a typical product of Metallwerke AG. are shown in the following table.

TABLE 7

Magnetic Properties of Product of Metallwerke AG. (Thickness of 0.3 mm; from JP, B1, 36-7352)

| | $H_c$ | $W_{10/50}$ | $\mu$ | $H_{15}$ |
|---|---|---|---|---|
| Cube Texture | | | | |
| Rolling Direction | 0.04~0.06 | 0.56 | 8500 | 0.46 |
| 45° Direction | 0.07~0.08 | 0.90 | — | 60 |
| 90° Direction | 0.04~0.06 | 0.56 | 8500 | 0.46 |
| Goss Texture | | | | |
| Rolling Direction | 0.11 | 0.45 | | 0.63 |
| 45° Direction | 0.23 | 5.6 | | 140 |
| 90° Direction | 0.28 | 1.7 | | 58 |

(4). Use of Cross Rolling and AlN (Nippon Steel Corporation)

JP, B1, No. 35-2657 discloses and claims a process for the preparation of a double oriented silicon steel sheet having an improved orientation and a reduced core loss comprising cold rolling a hot rolled silicon steel sheet containing from 2.0 to 4.0% of silicon and from 0.01 to 0.04% of aluminum in a first direction at a rolling reduction of from 40 to 80%, cold rolling the same in a second direction crossing the first direction at a rolling reduction of from 30 to 70%, annealing the cold rolled sheet at a temperature of from 750° to 1000° C. for a short period of time, and subjecting the sheet to a final annealing at a temperature of from 900° to 1300° C.

The principle underlying this process is such that after the formation of a matrix, in which the cube texture is likely to grow, by crossing rolling, secondary recrystallization driven by grain boundary energy is caused to proceed while impurity inhibition being effected by AlN. Patents relating to processes of this type are JP, B1, No. 35-2657; JP, B1, No. 35-17208; JP, B1, No. 38-1459; JP, B1, No. 38-8213; and JP, B1, No. 39-22491. Reference is also made to Acta Met., 14 (1966) p. 405; The Effects of AlN on Secondary Recrystallization Texture in Cold Rolled and Annealed (001) [100] Single Crystals of 3% Silicon Iron; S. Taguchi and A. Sakakura.

Magnetic properties of a typical product of Nippon Steel Corporation are shown in the following table.

TABLE 8

Magnetic Properties of Product of Nippon Steel Corp, (Thickness of 0.3 mm; from JP, B1, 35-17208)

| | $B_1$ | $W_{15/50}$ |
|---|---|---|
| Rolling Direction | 18340 | 0.98 |
| 90° Direction | 18150 | 1.05 |

(5). Fe=Al Alloys

Regarding electrical steel sheets of Fe-Al alloys many studies have been made for a long time. All of them are based on the formation of the cube texture by repeating rolling an annealing. The cube texture is more readily obtainable with Fe=Al alloys than with Fe=Si alloys, although the cube texture in Fe=Al alloys is not so sharp as that in Fe=Si alloys. Patents relating to processes for the formation of the cube texture with Fe=Al alloys are U.S., A, No. 2,875,114; U.S., A, No. 2,300,336; U.S., A, No. 3,058,857; JP, B1, No. 36-10806; U.S., A, No. 3,279,960; JP, B1, No. 41-2604 and JP, B1, No. 45-20576.

Magnetic properties of a typical product of the process of this type are shown in the followint table.

TABLE 9

Magnetic Properties of Product of JP, B1, 45-20576 (Thickness of 0.35 mm)

| | $B_{10}$ | $B_{25}$ | $B_{50}$ | $W_{10/50}$ | $W_{15/50}$ |
|---|---|---|---|---|---|
| Rolling Direction | 16800 | 18000 | 18500 | 0.60 | 1.40 |
| 90° Direction | 16500 | 17800 | 18400 | 0.63 | 1.40 |

Apart from academic interest, much attention is not paid to the products of the above-discussed prior art processes. This is partly because of their expensive manufacturing costs since the processes include commercially difficult technologies, and partly because properties of the products do not necessarily satisfy today's market needs.

Market Needs

The greatest demands for electrical steel sheets are core materials of large rotating machines, large- and medium-sized transformers as well as various small-sized, high performance rotors and transformers used in electronics fields. Generally, cores of large rotating machines are made of high grade non-oriented silicon steel sheets, while cores of large- and medium-sized transformers are made of high grade grain oriented silicon steel sheets. For cores of high performance rotors and transformers used in electronics fields, various soft magnetic materials, including non-oriented silicon steel sheets, grain oriented silicon steel sheets, thin oriented silicon steel sheets, "Permalloy", "Supermendur", "Amorphous" and soft ferrites, as well as hard magnetic materials, including ferritic magnets, are available.

Interesting possible applications of electrical steel sheets are use of them as magnetic materials in instruments for space and air crafts. Such instruments include, for example, motors, relays, transformers and magnetic amplifiers, all of them requiring light weight and high efficiency. Magnetic materials suitable for use in such instruments must exhibit not only an extremely low core loss and a high magnetic flux density, but also improved magnetic properties at working alternative high frequencies of the instruments, normally ranging between 1000 Hz and 50 KHz. Candidates for such magnetic materials would be thin matallic materials and soft ferrites. Exemplified for the thin metallic materials, one can mention "Supermendur" (48 Co=Fe alloy) of a thickness of 2 or 6 mil, a thin oriented silicon steel sheet (3% Si=Fe alloy of the (110) [001] type) of a thickness of 0.1 mm and a thin double oriented silicon steel sheet (3% Si=Fe alloy of the (100) [001] type supplied by Vacuumschmelze AG.) of a thickness of 0.1 mm. It is said that "Supermendur" is the best of its very low core loss and high magnetic flux density. See A. C. Beiler; Journal of Applied Physics, Vol. 38, No. 3 (1967) p. 1161. Regarding the soft ferrites, such as Mn-Zn ferrite, they exhibit satisfactory high frequency properties at ambient temperature, but because of their unduly low Curie points they are not suitable for use in instruments of space crafts, where problems relating to extra-ordinary temperature rising are posed.

More particularly, magnetic materials suitable for use in the above-mentioned instruments, in particular, as stator cores, rotor cores, frames, transformer cores and relay parts, are required to possess the following properties:

(1). high saturation magnetic flux density ($B_s$);

(2). low residual magnetic flux density ($B_r$), low coercive force ($H_c$), and low hysteresis loss ($W_h$);

(3). low core loss;

(4). low thermal expansion coefficient;

(5). low magnetostriction;

(6). high strength; and (7). above-mentioned properties after aging or at an elevated temperature (Curie points of typical metallic materials are shown in Table 10 below.).

TABLE 10

Curie Point

| Material | Curie Point |
|---|---|
| 50 Ni—50 Fe | 482° C. |
| 3% Si—Fe | 737° C. |
| Fe | 770° C. |
| 27% Co—Fe | 969° C. |
| 50 Co—50 Fe | 977° C. |
| Co | 1130° C. |

Among the existing thin metallic magnetic materials, the above-mentioned "Supermendur" (48 Co=Fe alloy) is the best, and its next is "Cubex" (the above-mentioned 3% Si=Fe alloy of the (100) [001] type supplied by Vacuumschmelze AG.).

However, the Co=Fe alloy is very expensive, and the "Cubex" has, because of its coarse grains, unsatisfactory magnetic properties at high frequencies. Accordingly, it is highly desired in the art to prepare a thin silicon steel sheet having orientation comparable to that of the "Cubex" and composed of finer grains. Such a material can be a substitute for the expensive Co=Fe alloy, although it is impossible to realize the Curie point of the Co=Fe alloy, which is inherent to the composition of the alloy.

OBJECT OF THE INVENTION

An object of the invention is to satisfy the above-discussed market needs.

DESCRIPTION OF THE INVENTION

The invention is based on a crystallographical discovery that an electrical steel sheet having a ferritic single phase of the (100) [001] oriented cube texture can be readily and inexpensively produced by suitably cold rolling and annealing a sheet of a single crystal or large grained cryatals of iron or iron alloy having an initial orientation of {114} <401> or near {114} <401>.

Thus, a process for the production of an electrical steel sheet having a ferritic single phase of the (100) [001] cube texture of iron or iron alloy, according to the invention, comprises:

cold rolling a sheet comprising a single crystal or large grained crystals of iron or iron alloy, in which said single crystal is or a majority of said large grained crystals are oriented so that the pole of the {114} plane may form an angle of not greater than 15° with the normal direction of the plane of the sheet, and the <401> direction may form an angle of not greater than 15° with a single direction in the plane of the sheet, in said single direction at a rolling reduction of at least 40%, and annealing the rolled sheet to form a primary recrystallization texture of fine grains of an average grain size of not larger than 5 mm under conditions preventing the occurance of secondary recrystallization.

The invention based on the above-mentioned crystallographical information is theoretically applicable to crystals of the body-centered crystal lattice. Thus, the metals contemplated herein include, pure iron and iron alloys having a composition rendering the metallic structure of the final product a ferritic single phase. It should be pointed out that it is frequently advantageous to modify the chemical composition of the product by addition of various alloying elements, including, for example, in % by weight, up to 8% of Si, up to 20% of Al, up to 5% of Mo, up to 25% of Cr, up to 6% of W, up to 3% of Ti, up to 3% of Nb and up to 5% of V. The composition of the iron alloy used in the practice of the process of the invention must be such that the metallic structure of the final product can be a single phase of ferrite.

Si serves to improve magnetic properties of the product, and is particularly effective for lowering the core loss of the product by increasing the electrical resistivities. It further improves the wear resistance of the product. As the Si content exceeds 5%, the workability of the product becomes worse, but this difficulty may be overcome by warm working, and thus, addition of Si in an amount of up to 8% is permissible. Al is effective for enhancing the permeability, increasing the electrical resistivities and improving the wear resistance. Especially, when Al is used in combination with Si, the wear resistance of the product is remarkably improved. However, addition of Al substantially in excess of 20% must be avoided, since it makes the product unduly brittle. Mo serves to enhance the permeability of the product. But as the amount of Mo added approaches and exceeds 5%, the effect of Mo to enhance the permeability tends to gradually and drastically decrease. Cr is very effective for improving the corrosion resistance of the product, and permitted to be used in an amount of up to 25%. Up to 6% of W, up to 3% of Ti, up to 3% of Nb and/or up to 5% of V may be also added for the purpose of improving various properties of the product. Other alloying elements, which may be used without adversely affecting the magnetic properties of the product, inlcude up to 2% of Sb, up to 2% of As and up to 2% of B.

The beneficial cube texture and advantageous magnetic properties of the product obtained by a process according to the invention may be adversely affected by the presence of impurities, including, for example, C, S, P, Se, N and O. Accordingly, the smallest possible amounts of such impurities are preferred for the purpose of the invention. These elements may be eliminated or reduced as far as possible at the stage of steel making or in one or more subsequent steps.

In the process according to the invention a sheet of a single crystal or large grained crystals of iron or iron alloy having an initial orientation of {114} <401> or near {114} <401> is cold rolled and annealed. More precisely, a sheet comprising a single crystal or large grained crystals of iron or iron alloy, in which said single crystal is or a majority of said lagre grained crystals are oriented so that the pole of the {114} plane may form an angle of not greater than 15° with the normal direction of the plane of the sheet, and the <401> direction may form an angle of not greater than 15° with a single direction in the plane of the sheet, is cold rolled in said single direction and annealed.

The cold rolling may be carried out in a single stage without any intermediate annealing step, although the number of passes of the sheet through the rolling mill necessary to achieve a desired rolling reduction is not limitative. The rolling reduction is defined by the following equation:

$$\text{Rolling reduction (\%)} = \frac{\text{Initial thickness} - \text{Final thickness}}{\text{Initial thickness}} \times 100$$

It is essential to carry out the cold rolling at a rolling reduction of at least 40%, preferably at least 60%, in order to realize the desired cube texture after the subsequent primary recrystallization. The annealing subsequent to the cold rolling may be carried out at a temperature at which primary recrystallization may proceed, for example, at a temperature ranging from about 700° C. to about 1100° C., for an appropriate period of time. The higher the annealing temperature, a shorter annealing time should be selected to avoid the occurance of secondary recrystallization. Use of annealing temperatures substantially in excess of about 1100° C., which promote secondary recrystallization, should also be avoided. If substantial secondary recrystallization proceeds, the product deviates from the desired cube texture. Furthermore, the avoidance of secondary recrystallization ensures fine grains, contributing to reduction in the core loss and eddy current loss of the product. Generally, grains having an average size of not larger than 5 mm are obtainable by the process according to the invention. Grains having an average size of not larger than 2 mm are preferred. The products may have a thickness of up to about 1.2 mm. In view of their reduced eddy current loss products having a thickness of from about 10 to about 200μ are preferred.

The starting material of the process according to the invention is a sheet of a single crystal or large grained cryatals of iron or iron alloy having an initial orientation of {114} <401> or near {114} <401>. It has not heretofore been known to start with the initial orientation of {114} <401> or near {114} <401> for producing the (100) [001] cube texture.

Table 11 shows initial orientation, texture after cold rolling, texture after primary recrystallization and texture after secondary recryatallization, of single crystals of 3% silicon iron, reported in literatures.

As revealed from Table 11, the prior art is based on such a concept that in order to realize the (100) [001] cube texture in silicon steel it is essential to start with crystals having an initial orientation of (100) [001] or near (100) [001], and let them undergo cold rolling and primary or secondary recrystallization. However, by starting with the initial orientation of (100) [001] or near (100) [001], the ideal (100) [001] cube texture is not obtained, as demonstrated hereinafter A convenient thickness of the starting sheet may range from about 50μ to about 6 mm.

The product obtained by the process according to the invention consists essentially of fine crystal grains having an average size of not greater than about 5 mm, preferably not greater than about 2 mm, and has the (100) [001] cube texture. By the term "the (100) [001] cube texture" we mean that the (100) plane of a majority of crystal grains is substantially parallel to the rolling plane, and the [001] axis of a majority of crystal grains is substantially parallel to the rolling direction, without deviating therefrom by an angle in excess of 15°. As demonstrated hereinafter, the product obtained by the process according to the invention has improved magnetic properties, in particular, it exhibits a surprisingly low core loss, especially at high frequencies, satisfying the market needs discussed above.

TABLE 11

Cold Rolled and Recrystallized Textures of Single Crystals Having Had Various Initial Orientations

| Initial Orientation | Orientation after Cold Rolling | Dispersed Precipitates (AlN) | Orientation after Primary Recrystallization | Orientation after Secondary Recrystallization | Literatures | |
|---|---|---|---|---|---|---|
| (110) [001] | main {111} <112> double symmetry sub, (100) [001] | P | main (110) [00$\bar{1}$]<br>sub. {120} <001><br>sub. {111} <110> | main {120} <001><br>{121} <012><br>{111} <110> | A. Sakakura, J. Appl. Phys., 40, (1969) 1534 | Prior Art |
| | | Q | main {111} <110><br>{110} <001> | main (110) [00$\bar{1}$] or no secondary recrystallization | A. Sakakura, J. Appl. Phys., 40, (1969) 1534 | |
| | | M | main (110) [00$\bar{1}$]<br>{120} <001><br>{111} <110> | main {120} <001><br>{121} <012><br>{111} <110> | C. G. Dunn, Acta. Met., 1, (1953) 163<br>C. G. Dunn, Acta. Met., 2, (1954) 173 | |
| (100) [001] | | P | main {113} <301><br>sub. (100) [00$\bar{1}$] | main (100) [00$\bar{1}$] | S. Taguchi and A. Sakakura, Acta. Met., 14, (1966) 405 | |
| | | Q | main {113} <301><br>sub. (100) [00$\bar{1}$] | no secondary recrystallization | S. Taguchi and S. Sakakura, Acta. Met., 14, (1966) 405 | |
| | main {110} <012> double symmetry | M | main {113} <301><br>sub. (100) [00$\bar{1}$] | no secondary recrystallization | J. L. Walter and W. R. Hibbard, Jr., AIME 212, Dec. (1958) 731 | |
| {113} <301> | {322} <011> | M | main (100) [00$\bar{1}$]<br>sub. {430} <001> | See FIG. 7 | This specification and attached drawings | According to the invention |
| {114} <401> | {511} <011> | M | main (100) [00$\bar{1}$]<br>sub. weak | | | |

NOTE:
Dispersed Precipitates
P: containing AlN needles of about 1μ length
Q: containing very fine AlN of about 100 angstrom length
M: containing no AlN The ideal (100) [001] cube texture has now been obtained in accordance with the invention starting with a single crystal or large grained crystals having an initial orientation of {114} <401> or near {114} <401>, such as {113} <301>, and letting such a crystal or crystals undergo cold rolling and primary recrystallization.

A sheet of a single crystal or large grained crystals having the critical initial orientation prescribed herein, which is used as the starting sheet in the process according to the invention can be prepared by methods known in themselves. For example, a cylindrical rod of a single crystal may be prepared by the Bridgman's method, and from the rod so prepared, a sheet of a single crystal having the desired orientation in the plane of the sheet may be cut out. Alternatively, a sheet of single crystal having the desired orientation may be prepared by a so-called strain anneal method as illustrated hereinafter.

Figure 2:
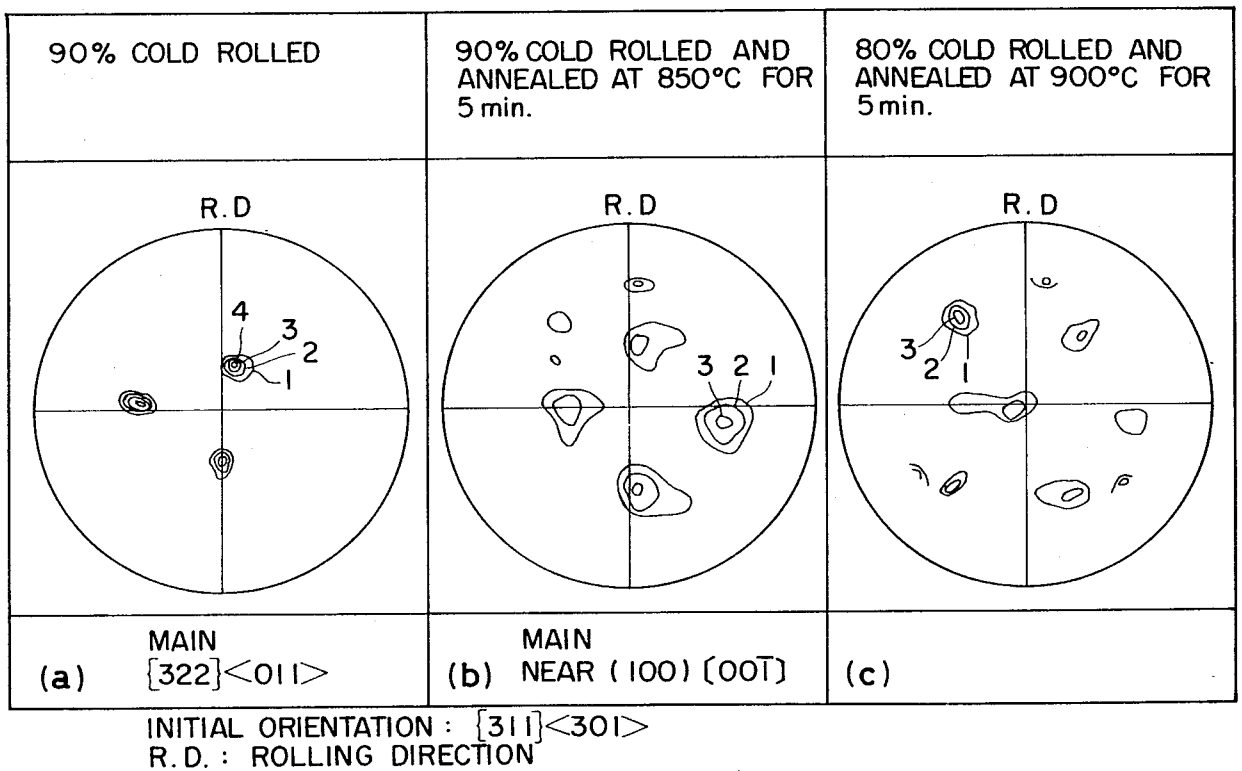
Figure 3:
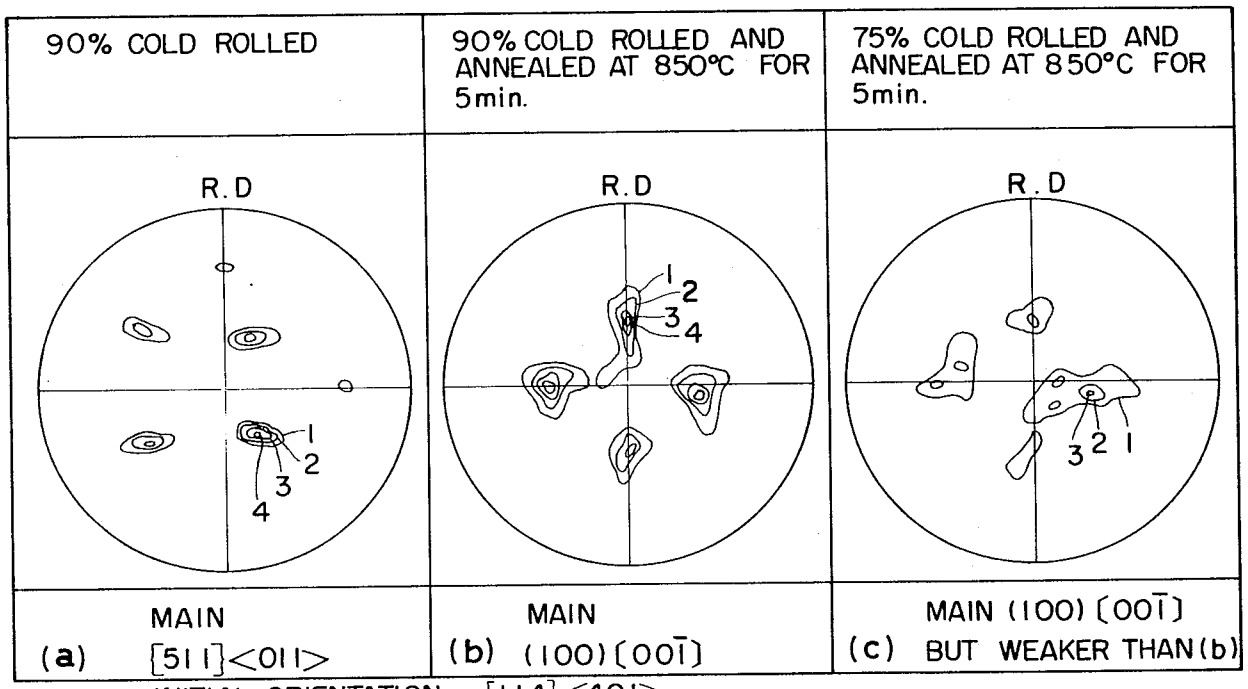
Figure 4:
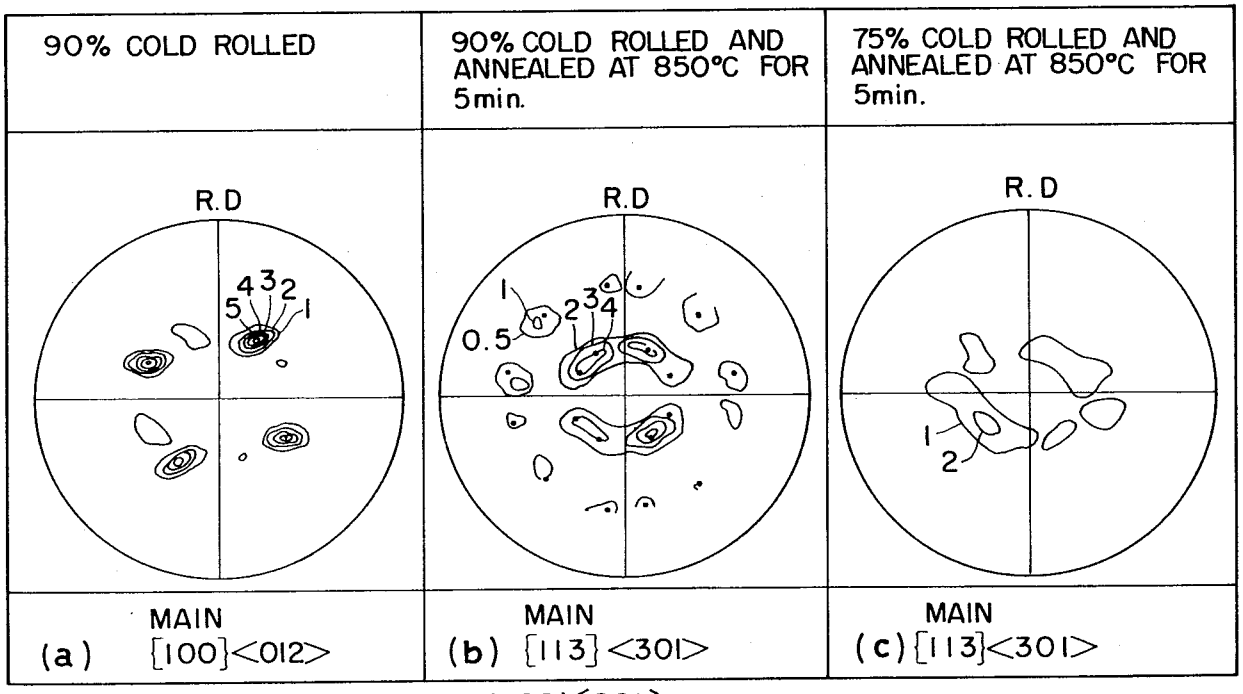
Figure 5:
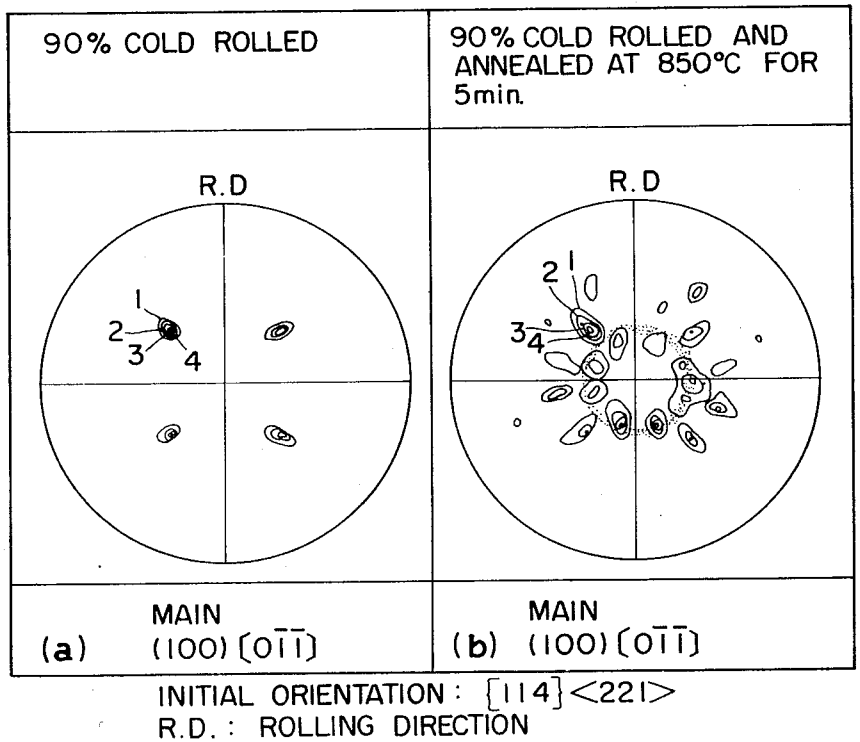
Figure 6A:
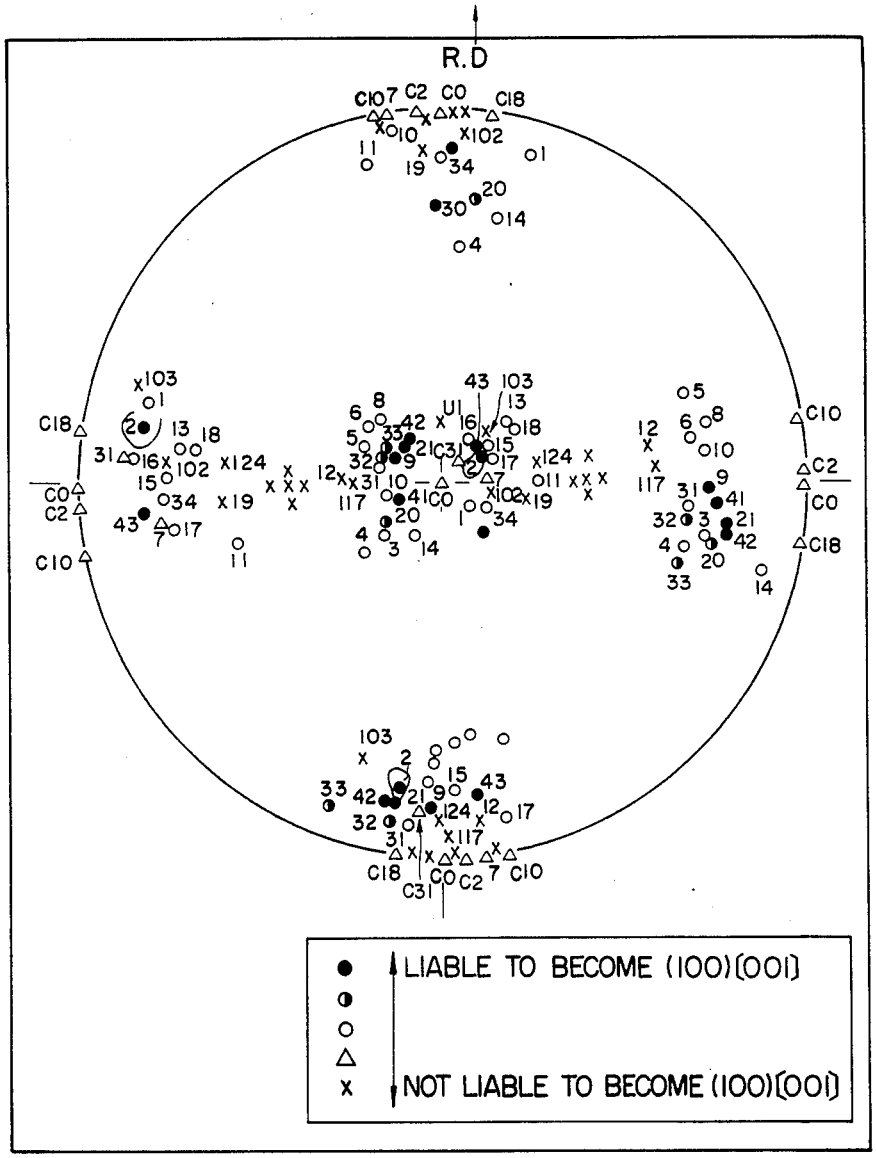
Figure 6B:
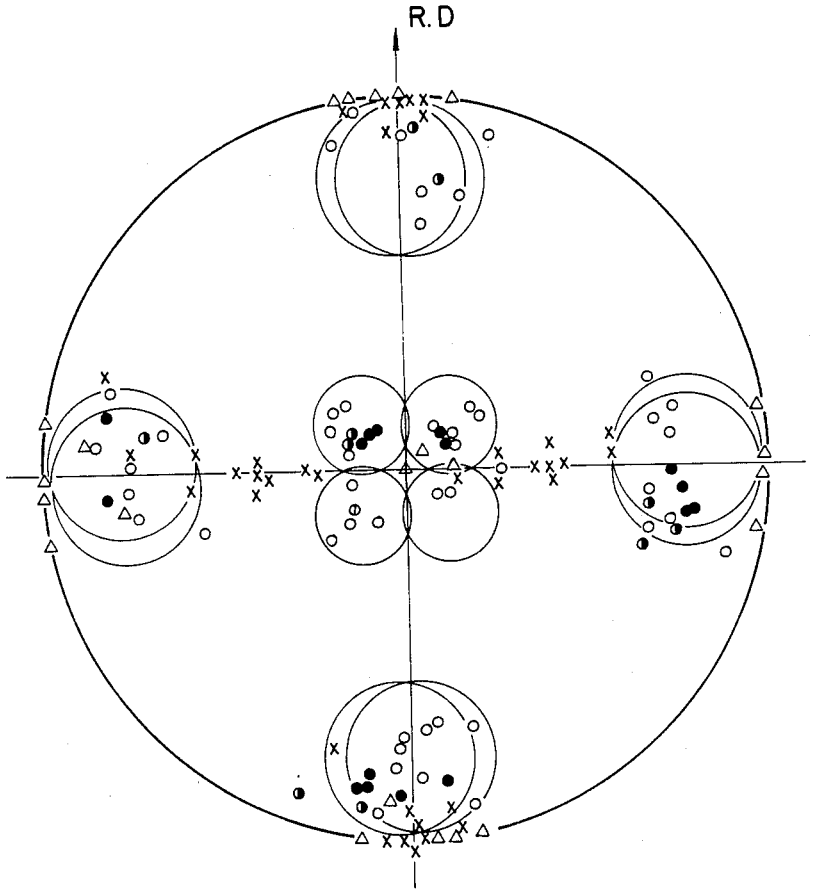
Figure 7:
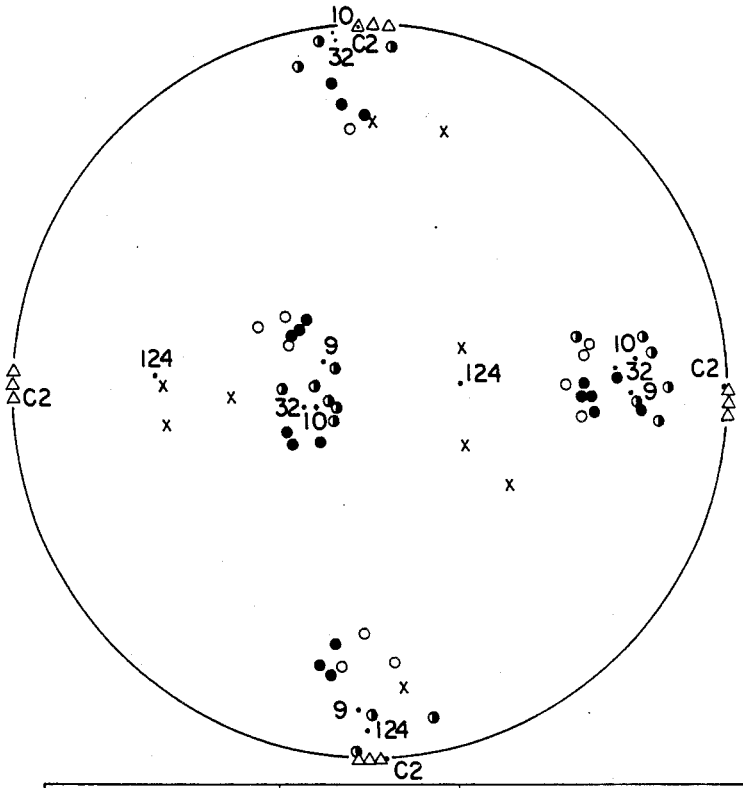
Figure 8:
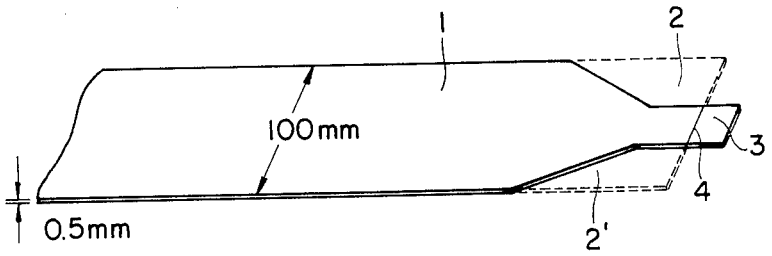

FIGS. 2(*a*), (*b*) and (*c*) are (110) pole figures of crystals having had an initial orientation of {113} <301>, after processed as indicated;

FIGS. 3(*a*), (*b*), and (*c*) are (110) pole figures of crystals having had an initial orientation of {114} <401>, after processed as indicated;

FIGS. 4(*a*), (*b*) and (*c*) are (110) pole figures of crystals having had an initial orientation of (100) [001] after processed as indicated;

FIGS. 5(*a*), and (*b*) are (110) pole figures of crystals having had an initial orientation of {114} <221>, after processed as indicated;

FIGS. 6(*a*) is a (100) pole figure showing initial orientations of single crystals with marks indicating the liability of becoming the (100) [001] cube texture by cold rolling and primary orientation;

FIGS. 6(*b*) is a (100) pole figure showing distributions of the initial orientations of single crystals, which will have the (100) [001] orientation when cold rolled and recrystallized, (the distributions are shown by circles in the figure);

FIG. 7 is a (100) pole figure showing the relationship between initial and secondary recrystallization orientations; and FIG. 8 is a perspective view of a sheet of single crystals being prepared for illustrating a method for the preparation.

The invention will be further described by the following experiments and with reference to the attached drawings.

Table 12 shows the chemical compositions of the steels used in the experiments.

TABLE 12

| Chemical Composition of Steels (% by weight) | | | |
|---|---|---|---|
| Steel No. | S1-1 | S1-2 | S1-3 |
| C | 0.0066 | 0.0032 | 0.0010 |
| Si | 2.81 | 3.09 | 3.01 |
| Mn | 0.16 | 0.12 | 0.08 |
| P | 0.006 | 0.007 | 0.003 |
| S | 0.026 | 0.0004 | 0.0005 |
| Ni | 0.02 | 0.12 | 0.03 |
| Cr | 0.50 | 0.06 | 0.02 |
| N | 0.0043 | 0.0005 | 0.0005 |
| O | 0.0080 | 0.0020 | 0.0005 |

Preparation Procedure I

An ingot of Steel No. S1-1 shown in Table 12 was forged to a cylindrical rod having a diameter of about 20 mm, and then ground to a rod having a diameter of about 15 mm and a length of about 90 mm, from which a rod of a single crystal having a diameter of about 15 mm and a length of about 80 mm was prepared by the well-known Bridgman method. A sheet of a single crystal with an initial orientation of {113} <301> having a thickness of 2.5 mm, a width of 10 mm and a length of 25 mm, was cut from the rod of a single crystl. Several such sheets were prepared in the same manner. Each sheet was cold rolled in the <301> direction at a rolling reduction of 80 or 90% and then annealed in a hydrogen atmosphere maintained at a temperature ranging from 850° to 950° C. for a period of time not longer than 30 min.

Preparation Procedure II

An ingot of Steel No. S1-3 shown in Table 12 was forged to a plate having a thickness of about 10 mm and a width of about 110 mm, and then ground to a plate having a thickness of about 7 mm, a width of about 100 mm and a length of about 400 m. The plate was hot rolled to a thickness of about 2 mm, and then ground to a sheet of a thickness of 1.5 mm. From the sheet so prepared, a sheet of a single crystal with an initial orientation of {114} <401> having a thickness of 1.5 mm, a width of 50 mm and a length of 250 mm, was prepared by the well-known strain anneal technique. Several such sheets were prepared in the same manner. Each sheet was cold rolled in the <401> direction at a rolling reduction of 75 to 90% and then annealed in a hydrogen atmosphere maintained at a temperature ranging from 850° to 1000° C. for a period of time not longer than 30 min.

Preparation Procedure III

An ingot of Steel No. S1-2 shown in Table 12 was forged to a plate having a thickness of about 10 mm and a width of about 110 mm, and then ground to a plate having a thickness of about 7 mm, a width of about 100 mm and a length of about 400 mm. The plate was cold rolled to a strip having a thickness of 1 mm and a width of 100 mm, which was then annealed in a hydrogen atmosphere maintained at a temperature of 850° C. for a period of 30 min. Edges at one end of the strip so prepared were cut off to make the width of the strip at that end narrower. A separately prepared single crystal having a particular orientation (100) [001], {114} <401> or {114} <221>, was welded to the strip at that narrow end by laser welding so that the (100) or {114} plane of the crystal may be substantially parallel to the plane of the strip and the [001], <401> or <221> direction of the crystal may be substantially parallel to the longitudinal direction of the strip. The strip was caused to pass with its welded end ahead through a temperature gradient furnace, in which a temperature gradient at 900° C. was 150° C./cm, at a speed of 0.2 mm/min. In this manner, several single crystal strips with an orientation of (100) [001], those with an orientation of {114} <401> and those with an orientation of {114} <221> were prepared.

Each strip was cold rolled in the longitudinal direction at a rolling reduction of 75 to 90% and then annealed in a hydrogen atmosphere maintained at a temperature ranging from 850° to 1000° C. for a period of time not longer than 30 min.

Test specimens prepared as in Preparation Procedures were examined for both the cold rolled and annealed textures. Some of them are shown by (100) pole figures of FIGS. 2 to 5.

1. Cold rolled and recrystallized orientations of crystals in the case of {113} <301> initial orientation (FIG. 2)

(a). The cold rolled orientation, in the case of a rolling reduction of 90%, is (322) [01$\bar{1}$, as seen from FIG. 1(*a*).

(b). The primary recrystallization orientation, in the case of a rolling reduction of 90%, comprises mainly {115} <501>, and contains (430) [001] and (210) {$\bar{1}$23} as subsidiary orienrations, as seen from FIG. 2(*b*).

(c). In the case of a rolling reduction of 80%, approximately the same amounts of {115} <501> and (430) [001] appear in the primary recrystallization orientation, as seen from FIG. 2(*c*).

In both cases of (b) and (c) 95% or more of the grains had a size below 1 mm.

2. Cold rolled and recrystallized orientations of crystals in the case of {114} <401> initial orientation (FIG. 3)

(a). The cold rolled orientation, in the case of a rolling reduction of 90%, is {511} <011> as seen from FIG. 3(*a*).

(b). The primary recrystallization orientation, in the case of a rolling reduction of 90%, comprises mainly (100) [001], as seen from FIG. 3(*b*).

(c). The primary recrystallization orientation, in the case of a rolling reduction of 75%, comprises mainly (100) [015], and contains (210)~(430) [hkl] subsidiary orientations, as seen from FIG. 3(*c*).

3. Cold rolled and recrystallized orientations of crystals in the case of (100) [001] initial orientation (FIG. 4)

In the case of (100) [001] initial orientation, the primary recrystallization orientation is quadruply symmetrical {113} <301>, and thus the (100) [001] type cube texture is not obtained, as seen from FIGS. 4(*b*) and (*c*).

4. Cold rolled and recrystallized orientations of crystals in the case of {114} <221> initial orientation (FIG. 5)

In the case of {114} <221> initial orientation, the primary recrystallization orientation is (100) [01$\bar{1}$], and thus the cube texture is not obtained, as seen from FIG. 5(*b*).

It is revealed from the test results that the (100) [001] type cube texture is not obtained by cold rolling the (100) plane of single crystals in the [001] direction followed by recrystallization; rather the ideal (100) [001] type cube texture can be obtained by cold rolling the {114} plane of single crystalls in the <401> direction followed by recrystallization; and further single cryatals of the {113} <301> initial orientation, which is near {114} <401>, is also useful for providing a cube texture very near {114} <401> by cold rolling and recrystallization.

Based on the newly discovered information, we carried out experiments in order to determine a range of initial orientations of a starting material suitable for the provision of the desired cube texture of (100) {001}. In the experiments, single crystals having various predetermined initial orientations were cold rolled in various crystographical directions at a rolling reduction of from 80 to 90%, and then annealed at a temperature of 850° C. for 30 minutes to effect primary recrystallization. Some of them were further annealed at a temperature of from 1100° to 1200° C. to effect secondary recrystallization. For the annealed samples (100) pole figures were made. The results are summarized in FIGS. 6(*a*) and (*b*).

FIG. 6(*a*) depicts initial orientations of the tested single crystals with marks showing a liability of recrystallizing to the (100) [001] orientation by cold rolling and primary recrystallization. The marks ●, ◑, ○, Δ and X indicates the nearness of the recrystallized crystal to the (100) [001] orientation in the order of from the nearest to the most remote. For each tested single crystal, the type of the initial orientation, the angular deviations of the (100) pole from the rolling plane (RP) and rolling direction (RD) for the purpose of showing the exact initial orientation, the measured magnetic torque of the recrystallized grain and its % based on the theoretical value calculated for the (100) [001] cube texture together with the identification number of crystal and the mark indicated in FIG. 6(*a*), are shown in Table 13.

TABLE 13

Relationship between Initial Orientation of Single Crystal and Liability of Recrystallizing to (100) [001] type Cube Texture

| Type of Initial Orientation | Angular Deviations (deg) from RP | Angular Deviations (deg) from RD | Magnetic Torque of Recrystallized Grain × $10^4$ erg/cc | Magnetic Torque of Recrystallized Grain % | Remarks No. of Crystal | Remarks Mark |
|---|---|---|---|---|---|---|
| {114} | 16 | 15 | 16.5 | 92 | 2 | ● |
| | 17 | 9 | 17.0 | 95 | 9 | ● |
| | 15 | 12 | 18.3 | 100 | 21 | ● |
| | 15 | 6 | 17.0 | 94 | 41 | ● |
| | 17 | 14 | 18.0 | 100 | 42 | ● |
| | 16 | 13 | | | 43 | ● |
| near {114} | 20 | 21 | 15.9 | 88 | 20 | ◑ |
| | 20 | 12 | 15.8 | 88 | 32 | ◑ |
| | 20 | 21 | 16.0 | 89 | 33 | ◑ |
| {114} <221> | 19 | 48 | | | U1 | X |
| near {113} | 12 | 15 | | | 1 | ○ |
| | 22 | 16 | | | 3 | ○ |
| | 32 | 25 | | | 4 | ○ |
| | 26 | 24 | | | 5 | ○ |
| | 27 | 20 | | | 6 | ○ |
| | 27 | 23 | | | 8 | ○ |
| | 17 | 8 | 15.6 | 86 | 10 | ○ |
| | 32 | 14 | | | 11 | ○ |
| | 28 | 19 | | | 13 | ○ |
| | 18 | 22 | | | 14 | ○ |

TABLE 13-continued

Relationship between Initial Orientation of Single Crystal and Liability of Recrystallizing to (100) [001] type Cube Texture

| Type of Initial Orientation | Angular Deviations (deg) from RP | Angular Deviations (deg) from RD | Magnetic Torque of Recrystallized Grain × $10^4$ erg/cc | Magnetic Torque of Recrystallized Grain % | Remarks No. of Crystal | Remarks Mark |
|---|---|---|---|---|---|---|
| | 17 | 8 | | | 15 | ○ |
| | 16 | 14 | | | 16 | ○ |
| | 18 | 10 | | | 17 | ○ |
| | 28 | 17 | | | 18 | ○ |
| | 20 | 8 | | | 31 | ○ |
| near {100} | 14 | 7 | 14.5 | 81 | 7 | Δ |
| | 0 | 0 | 14.8 | 82 | $C_0$ | Δ |
| | 0 | 3 | 12.8 | 71 | $C_2$ | Δ |
| | 0 | 10 | 15.8 | 88 | $C_{10}$ | Δ |
| | 0 | 8 | 13.6 | 75 | $C_{18}$ | Δ |
| | 8 | 8 | 12.9 | 72 | $C_{31}$ | Δ |
| near {120} | 30 | 7 | | | 12 | X |
| | 28 | 7 | | | 19 | X |
| | 28 | 3 | | | 117 | X |
| | 17 | 25 | 14.3 | 79 | 103 | X |
| | 30 | 12 | | | 104 | X |
| | 17 | 6 | 13.3 | 74 | 124 | X |

FIG. 6(*a*) again reveals the fact that when the starting sheet of single cryatals has an initial orientation of {114} <401> or near {114} <401>, it recrystallizes to the ideal (100) [001] cube texture. This is substantiated by the data on the measured magnetic torque (magnetic rotation) of the tested single cryatals, shown in Table 12.

FIG. 6(*b*) is a copy of FIG. 6(*a*) in which the crystal numbers are omitted and allowable angular deviations from the {114} <401> are indicated by circles. The four relatively small circles at the center of the figure show the ranges in which the angular deviation of the rolling plane (the plane of the sheet) from the {114} is not greater than 15°, and relatively large circles in the peripheral portions of the figure show the ranges in which the angular deviation of the rolling direction from the <401> is not greater than 15°. Incidentally, an initial orientation of {113} <301> falls within the ranges of allowable angular deviations contemplated herein.

FIG. 7 is a (001) pole figure showing relationship between initial orientations of the tested single crystals and secondary recrystllization orientations. It is revealed from FIG. 7 that even starting with single crystals Nos. 9 and 32, which have the critical initial orientations prescribed herein, secondary recrystallization orientations obtainable therefrom are not the desired (100) [001].

It is said by J. L. Walter and W. R. Hibbard, Jr. in Trans. AIME, Vol. 212, December, (1958), page 731, with reference to FIG. 7 that when crystals having the (100) plane parallel to or deviated by an angle of not greater than 30° from the rolling plane, are cold rolled and recrystallized, they recrystallizes to essentially a cube texture. However, in the case of the initial orientation of (100) [001] or near (100) [001] the primary recrystallization orientation is quadruply symmetrical {113} <301>, as shown by S. Taguchi and A. Sakakura in Acta. Met., 14 (1966) page 405. This is also shown in FIG. 4 of the attached drawings. Further, the data on the magnetic torque shown in Table 12 substantiate that the essential cube texture referred to in the article of Walter et al would have been a pseudo-cube texture, which may exhibit only about 80% of the theoretical magnetic rotation (magnetic torque) calculated for the ideal (100) [001] cube textrue.

EXAMPLE

A slab of silicon steel containing in % by weight 0.0030% of C, 3.10% of Si, 0.10% of Mn, 0.006% of P, 0.004% of S, 0,20% of Cr, 0.30% of Mo, 0.001% of O and 0.003% of N, was hot rolled to a hot gage of 2.0 mm, which was then cold rolled to a strip of a thickness of 0.5 mm. The strip was coated with magnesia powder, maitained in a hydrogen atmosphere at a temperature of 1050° C. for about 3 hours, and then allowed to cool. The strip consisted essentially of 0.0029% of C, 3.09% of Si, 0.10% of Mn, 0.006% of P, 0.0009% of S, 0.20% of Cr, 0.29% of Mo, 0.0009% of O and 0.0005% of N, the balance being Fe. The strip was slit to s width of 100 mm.

Now referring to FIG. 8, edges 2 and 2' at one end of the strip 1 having a thickness of 0.5 mm and a width of 100 mm were removed by etching to make that end narrow. To the narrow end, a sheet of a seed single crystal 3 having the (114) crystalline plane, which had been separately prepared from the same material as that of the strip, was welded by laser beam so that the (114) plane of the seed crystal may be parallel to the plane of the strip and the [401] axis of the seed crystal may be parallel to the longitudinal direction (that is the rolling direction) of the strip. The reference numeral 4 designates the weld line. The strip was then caused to pass with its welded end ahead at a speed of 0.5 mm/min. through a temperature gradient electric furnace having a maximum temperature of 1150° C. and an average temperature gradient of about 180° C./cm at a zone of about 900° C. In this manner single crystal strips having the (114) plane parallel to the plane of the strip and the [401] direction parallel to the longitudinal direction of the strip were prepared.

One strip so prepared was cold rolled to a thickness of 0.1 mm (80% reduction in thickness), while another to a thickness of 0.05 mm (90% reduction in thickness), by means of a 20 height cold rolling mill, and the cold rolled strips were continuously annealed by passing them through a hydrogen atmosphere maintained at a temperature of 1000° C. within 5 minutes.

Figure 1:
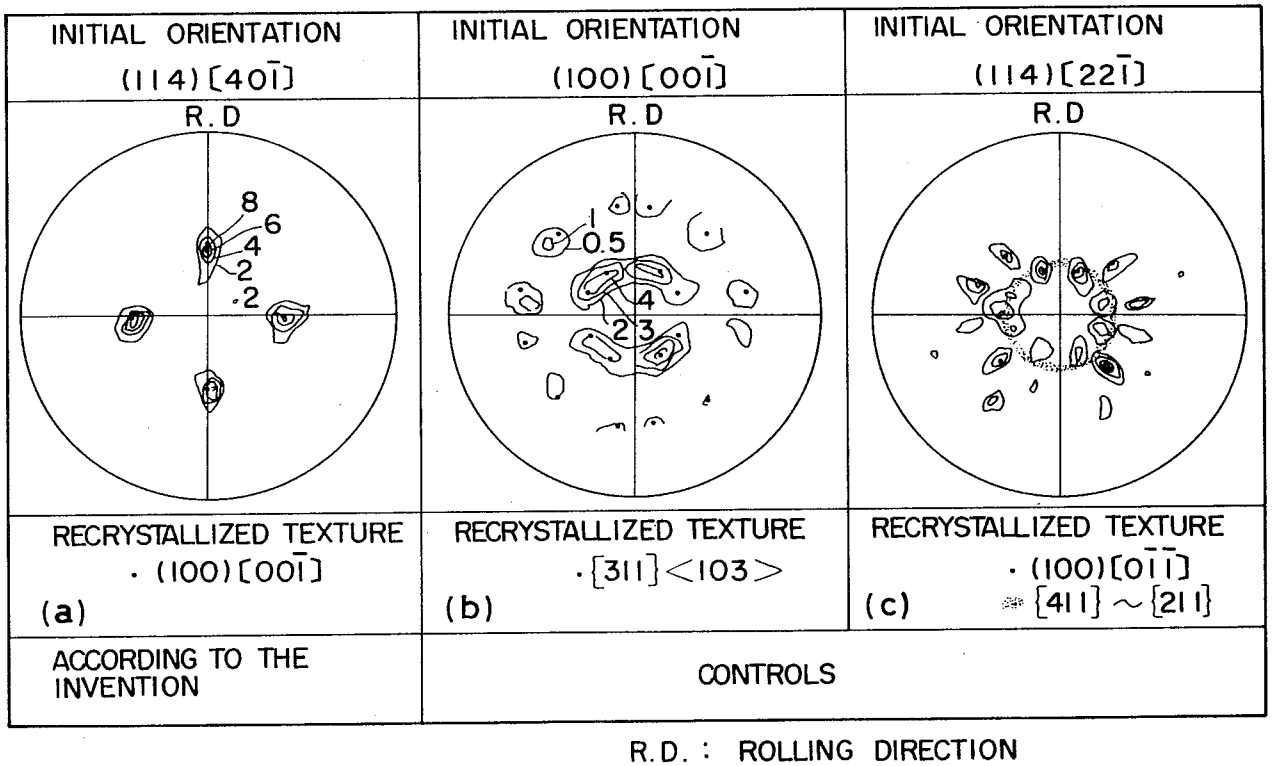
FIGS. 1(*a*), (*b*) and (*c*) are (110) pole figures of cold rolled and recrystallized crystals which have had the indicated initial orientations.

The product, which was cold rolled at a rolling reduction of 90% and annealed at 1000° C. for 5 minutes, exhibited a magnetic torque of $17.9\times10^4$ erg/cc and had an average grain size of about 0.2 mm. FIG. 1(*a*) is a (100) pole figure of this product. For comparison purposes, results obtained from (100) [001] and (114) [221] initial orientations under comparative conditions are shown in FIGS. 1(*b*) and (*c*), respectively.

Some magnetic properties of both the products having thicknesses of 0.05 mm and 0.1 mm are shown in Table 14. For comparison purposes, magnetic properties of prior art products are also shown in Table 14. It is revealed from Table 14 that products obtained by a process in accordance with the invention have improved magnetic properties, especially at high frequencies.

TABLE 14

Magnetic Properties

| Product | Thickness μ | M.D. | DC Magnetic Properties μ 0.01 | μ 0.1 | μ Max | $B_1$ | $B_2$ | $B_5$ | $B_{10}$ | $B_s$ | $B_r$ | $H_c$ |
|---|---|---|---|---|---|---|---|---|---|---|---|---|
| A | 50 | R | 2600 | 34000 | 44000 | | 17500 | | 19200 | 20200 | | |
| | 100 | R | 2030 | 22000 | 40300 | | 17000 | | 19000 | 20200 | | |
| B | 300 | R | | | 90600 | | 16600 | | | | 13100 | 0.100 |
| | 300 | T | | | 58700 | | 16000 | | | | 11650 | 0.135 |
| C | 50 | R + T | | | 27000 | 12900 | | 16300 | 16800 | | | 0.175 |
| | 100 | R | | | 42000 | 13300 | | 16500 | 17000 | | | 0.115 |
| D | 350 | R | μ = 8500 | | | | | | | | | 0.05 |
| | 350 | T | μ = 8500 | | | | | | | | | 0.05 |
| E | 300 | R | | | | | | | 18340 | 20300 | | |
| | 300 | T | | | | | | | 18150 | 20300 | | |
| F | 350 | R | | | | | | | 16800 | 18500 | | |
| | 350 | T | | | | | | | 16500 | 18400 | | |
| G | 100 | coiled core | | | 39000 | | 16200 | | 17500 | | 12100 | 0.12 |
| H | 50 | R | | | | | | | | | | |
| | 100 | R | | | | | | | | | | |

| Product | Thickness μ | M.D. | AC Magnetic Properties $W_{5/50}$ | $W_{5/400}$ | $W_{5/1000}$ | $W_{10/50}$ | $W_{10/400}$ | $W_{10/1000}$ | $W_{15/50}$ | $W_{10/400}$ | $W_{15/1000}$ |
|---|---|---|---|---|---|---|---|---|---|---|---|
| A | 50 | R | 0.12 | 1.4 | 4.7 | 0.35 | 5.0 | 16.2 | 0.62 | 9.8 | 35.6 |
| | 100 | R | 0.14 | 1.6 | 6.2 | 0.40 | 5.8 | 19.5 | 0.87 | 11.1 | 45.2 |
| B | 300 | R | | | | | | | 1.03 | | |
| | 300 | T | | | | | | | 1.19 | | |
| C | 50 | R + T | | | | 0.55 | | | 1.23 | | |
| | 100 | R | | | | 0.57 | | | 1.32 | | |
| D | 350 | R | | | | 0.56 | | | | | |
| | 350 | T | | | | 0.56 | | | | | |
| E | 300 | R | | | | | | | 0.98 | | |
| | 300 | T | | | | | | | 1.05 | | |
| F | 350 | R | | | | 0.60 | | | 1.40 | | |
| | 350 | T | | | | 0.63 | | | 1.40 | | |
| G | 100 | coiled core | | | | 0.48 | | | 1.05 | | |
| H | 50 | R | | | 4.8 | | 6.4 | 17.2 | | 13.8 | |

TABLE 14-continued

| | | Magnetic Properties | | | |
|---|---|---|---|---|---|
| 100 | R | 6.5 | 6.0 | 22.7 | 13.0 |

NOTE
A: According to the invention
B: Described in JP, B1, 33-7509
C: Described in J. Applied Physics, Vol. 20, No. 3, page 363 (1958)
D: Described in JP, B1, 36-7352
E: Described in JP, B1, 35-17208
F: Described in JP, B1, 45-20576
G: Described in Technical Pamphlet of Tohoku Metals Co. Ltd. under a product name of "SPS-C"
H: Described in Technical Pamphlet of Nippon Metals Co. Ltd. under a product name of "GT"
M.D.: Measuring Direction: R: Rolling direction, T: Transverse direction
$B_1 \sim B_{10}$: Magnetic flux densities in Gauss at 1 ~ 10 Oersted, respectively
$B_s$: Saturation magnetic flux density in Gauss
$B_r$: Residual magnetic flux density in Gauss
$H_c$: Coercive force in Oersted
$W_{5/50} \sim W_{15/1000}$: Core losses in W/Kg at 5000 Gauss and 50 Hz ~ 15000 Gauss and 1000 Hz

What is claimed is:

1. A process for the production of an electrical steel sheet having a ferritic single phase of the (100) [001] oriented cube texture of iron or iron alloy, comprising the steps of:

cold rolling a sheet consisting essentially of a single crystal of iron or iron alloy, in which said single crystal is oriented so that the pole of the {114} plane may form an angle of not greater than 15° with the normal direction of plane of the sheet, and the <401> direction may form an angle of not greater than 15° with the longitudinal direction of the sheet, along the longitudinal direction of the sheet at a rolling reduction of at least 40%, and annealing the rolled sheet to form a primary recrystallization texture of fine grains of an average grain size of not larger than 5 mm under conditions preventing the occurrence of secondary recrystallization.

2. The process in accordance with claim 1 wherein the starting sheet has a thickness of from 50μ to 6.0 mm and cold rolled at a rolling reduction of at least 60%.

3. The process in accordance with claim 1 wherein the rolled sheet is annealed to form a primary recrystallization texture of fine grains of an average grain size of not larger than 2 mm.

4. The process in accordance with claim 1, wherein the iron alloy is an iron-silicon alloy containing up to 8 percent by weight silicon.

5. The process according to claim 1, wherein $B_{10}$ of said electrical steel sheet is 19,000 to 19,200.

6. The process according to claim 1 wherein the steel sheet has 92 to 100 percent cubic texture.

7. The process according to claim 4 wherein the $B_{10}$ value of the electrical steel sheet is 19,000 to 19,200 and the sheet has 92 to 100 percent cubic texture.

* * * * *